US011072193B2

(12) United States Patent
Kawajiri

(10) Patent No.: US 11,072,193 B2
(45) Date of Patent: Jul. 27, 2021

(54) PAPER CONVEYANCE DEVICE, AND PRINTER

(71) Applicant: SEIKO EPSON CORPORATION, Tokyo (JP)

(72) Inventor: Masahiro Kawajiri, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 204 days.

(21) Appl. No.: 15/926,650

(22) Filed: Mar. 20, 2018

(65) Prior Publication Data

US 2018/0272767 A1 Sep. 27, 2018

(30) Foreign Application Priority Data

Mar. 22, 2017 (JP) ..... 2017-055807

(51) Int. Cl.
*B41J 15/04* (2006.01)
*B65H 16/10* (2006.01)
(Continued)

(52) U.S. Cl.
CPC ..... *B41J 15/048* (2013.01); *B41J 15/042* (2013.01); *B41J 15/046* (2013.01); *B41J 15/08* (2013.01);
(Continued)

(58) Field of Classification Search
CPC ..... B41J 15/042; B41J 15/046; B41J 15/048; B41J 15/06; B41J 15/08; B65H 16/06; B65H 16/10; B65H 2301/413683; B65H 16/04; B65H 2301/12; B65H 2301/41335; B65H 2301/41368; B65H 2405/451; B65H 2405/2801; B65H 2405/12; B65H 35/0006
See application file for complete search history.

(56) References Cited

U.S. PATENT DOCUMENTS 3,840,194 A * 10/1974 Vetter ..... B65H 75/185 242/613.5
4,179,077 A * 12/1979 Morishita ..... B41J 15/02 242/423
(Continued)

FOREIGN PATENT DOCUMENTS

CN 1636754 A 7/2005
CN 104724530 A 6/2015
(Continued)

*Primary Examiner* — Matthew G Marini
*Assistant Examiner* — Marissa Ferguson-Samreth
(74) *Attorney, Agent, or Firm* — Chip Law Group

(57) ABSTRACT

A paper compartment in which roll paper can be held has an opening positioned along the second axial end of the roll paper and a wall positioned along the first axial end of the roll paper in the axial direction. The paper loading member can be removably installed in the paper compartment through the opening. The paper loading member has a flange and a roll support member that projects from the flange and is inserted into the paper. When roll paper is held in the paper compartment, the paper loading member is installed in the paper compartment with a first side of the flange contacting the first axial end of the paper, and the roll support member is inserted into the roll paper. When the paper loading member is installed in the paper compartment, the first side of the flange faces the opening.

13 Claims, 7 Drawing Sheets

(51) Int. Cl.

| | |
|---|---|
| ***B65H 16/06*** | (2006.01) |
| ***B41J 15/08*** | (2006.01) |
| ***B65H 16/04*** | (2006.01) |
| *B65H 35/00* | (2006.01) |

(52) U.S. Cl.

CPC ..... *B65H 16/04* (2013.01); *B65H 16/06* (2013.01); *B65H 16/10* (2013.01); *B65H 35/0006* (2013.01); *B65H 2301/12* (2013.01); *B65H 2301/41335* (2013.01); *B65H 2301/41368* (2013.01); *B65H 2301/413683* (2013.01); *B65H 2405/451* (2013.01); *B65H 2801/12* (2013.01)

(56) References Cited

U.S. PATENT DOCUMENTS

| | | | | |
|---|---|---|---|---|
| 4,534,519 | A * | 8/1985 | Euteneuer | B65H 75/245 242/571.8 |
| 9,440,813 | B2 | 9/2016 | Kawajiri et al. | |
| 10,093,501 | B2 | 10/2018 | Kawajiri et al. | |
| 10,479,633 | B2 | 11/2019 | Kawajiri et al. | |
| 2005/0147451 | A1 | 7/2005 | Sugimoto et al. | |
| 2005/0258301 | A1* | 11/2005 | Hirte | B65H 16/04 242/597.6 |
| 2006/0269347 | A1 | 11/2006 | Sugimoto et al. | |
| 2007/0071531 | A1 | 12/2007 | Sugimoto et al. | |
| 2008/0003044 | A1 | 1/2008 | Sugimoto et al. | |
| 2011/0229241 | A1* | 9/2011 | Takahashi | B65H 75/14 400/611 |
| 2011/0262202 | A1 | 10/2011 | Izumi | |
| 2013/0272767 | A1* | 10/2013 | Tanaka | B41J 15/042 400/578 |
| 2015/0174933 | A1 | 6/2015 | Kawajiri et al. | |
| 2016/0347566 | A1 | 12/2016 | Kawajiri et al. | |
| 2018/0079542 | A1* | 3/2018 | Hashimoto | B65B 41/12 |
| 2018/0354735 | A1 | 12/2018 | Kawajiri et al. | |

FOREIGN PATENT DOCUMENTS

| | | | | | |
|---|---|---|---|---|---|
| JP | H07323942 | A | | 12/1995 | |
| JP | H10305816 | A | | 11/1998 | |
| JP | H1179484 | A | | 3/1999 | |
| JP | 2003-063743 | A | | 3/2003 | |
| JP | 2006-315791 | A | | 11/2006 | |
| JP | 2007-008624 | | * | 1/2007 | B65H 16/06 |
| JP | 2008-297045 | | * | 12/2008 | B65H 16/06 |
| JP | 2011-230865 | A | | 11/2011 | |
| JP | 2013-121874 | | * | 6/2013 | B65H 26/00 |
| JP | 2014-051352 | | * | 3/2014 | B65H 75/14 |
| JP | 2014-144556 | | * | 8/2014 | B65H 16/04 |
| JP | 2015-129028 | | * | 7/2015 | B41J 15/00 |
| JP | 2015-134686 | | * | 7/2015 | B65H 23/16 |
| JP | 2015134686 | | * | 7/2015 | B65H 18/10 |
| JP | 2019-018945 | | * | 2/2019 | B65H 16/06 |

* cited by examiner

PAPER CONVEYANCE DEVICE, AND PRINTER

CROSS-REFERENCE TO RELATED PATENT APPLICATIONS

This application claims priority and the benefit of Japan Priority Application 2017-055807, filed Mar. 22, 2017, the entire disclosure of which is incorporated herein by reference in its entirety.

FIELD

The present disclosure relates generally to a paper conveyance device and a printer.

BACKGROUND

Paper conveyance devices (continuous sheet roll holding devices) that store roll paper (a continuous sheet wound into a roll) are known from the literature. See, for example, JP-A-2011-230865.

With devices that store paper in a roll such as the paper conveyance device described above, there is a need to simplify loading the paper and improve user convenience. This need is also confronted in printing devices that have a printing function and are configured to print on stored roll paper.

SUMMARY

Some embodiment disclosed herein are directed to this above-mentioned need, providing a paper conveyance device and printer that simplify loading or installing roll paper.

A paper conveyance device according to one embodiment has a paper compartment and a paper loading member. The paper compartment is configured to hold roll paper that extends between a first axial end and a second axial end. The paper compartment has an opening positioned along the second axial end of the roll paper when the roll paper is held in the paper compartment. The paper loading member is configured to be removably installed in the paper compartment through the opening. The paper loading member includes a flange and a roll support member that protrudes from the flange and is configured to be inserted into the core of the paper. When the roll paper is held in the paper compartment, the paper loading member is installed in the paper compartment with a first side of the flange contacting the first axial end of the roll paper, and the roll support member is inserted into the core of the roll paper. When the paper loading member is installed in the paper compartment, the first side of the flange of the paper loading member is the side of the flange that faces the opening of the paper compartment.

This configuration enables installing paper in the paper compartment by the simple process of inserting the roll support member of the paper loading member in the paper so that one side of the paper roll contacts one side of the flange, and then loading the paper loading member through the opening to the paper compartment.

In a paper conveyance device according to another embodiment, the length of the roll support member is greater than the maximum width of the roll paper held in the paper compartment.

This configuration can stabilize the paper with the roll support member.

In a paper conveyance device according to another embodiment, the roll support member has a through-hole passing lengthwise through the roll support member, the paper compartment has a roll spindle extending along the axial direction of the roll paper held in the paper compartment, and the roll spindle is inserted into the through-hole of the roll support member when the paper loading member is installed in the paper compartment.

This configuration enables installing the paper loading member to the paper compartment by the simple task of inserting the roll spindle to the through-hole in the roll support member.

In a paper conveyance device according to another embodiment, the length of the roll spindle is greater than the length of the roll support member, and when the paper loading member is installed in the paper compartment, the an opening-side end of the roll spindle of the paper compartment is closer to the opening of the paper compartment than an opening-side end of the roll support member of the paper loading member.

This configuration can stabilize the roll support member by the roll spindle.

In a paper conveyance device according to another embodiment, the roll spindle has a marking indicating a position of the opening-side end of the roll support member.

This configuration enables the user to use the marking on the roll spindle to easily confirm the position of the roll support member on the roll spindle.

A paper conveyance device according to another embodiment preferably also has a roll support member stop that is configured to be installed on the roll spindle to which the paper loading member is installed and restrict the position of the roll support member on the roll spindle.

This configuration enables appropriately positioning the roll support member to the roll spindle by the roll support member stop.

A paper conveyance device according to another embodiment preferably also has a paper stop that is configured to be installed to the roll support member when the first axial end of the roll paper is in contact with the one side of the flange and the roll support member is inserted into the core of the roll paper, contact the second axial end of the roll paper installed on the roll support member, and restrict the position of the roll paper on the roll support member.

This configuration enables appropriately restricting the position of the paper on the roll support member with the paper stop.

A paper conveyance device according to another embodiment has an arrangement where the paper compartment has a wall positioned closer to the first axial end of the roll paper than the second axial end of the roll paper when the roll paper is held in the paper compartment.

A paper conveyance device according to another embodiment has an arrangement where, when the paper loading member is installed in the paper compartment, a second side of the flange contacts the wall. The second side of the flange faces the wall of the paper compartment.

Another embodiment is a printing device that includes a paper compartment, a printing mechanism, and a paper loading member. The paper compartment is configured to hold roll paper that extends between a first axial end and a second axial end. The paper compartment has an opening positioned along the second axial end of the roll paper when the roll paper is held in the paper compartment and a wall positioned along the first axial end of the roll paper when the roll paper is held in the paper compartment. The printing mechanism is configured to print on the roll paper. The paper loading member is configured to be removably installed in the paper compartment through the opening. The paper loading member includes a flange and a roll support member that protrudes from the flange and is configured to be inserted into the core of the paper. When the roll paper is held in the paper compartment, the paper loading member is installed in the paper compartment with a first side of the flange contacting the first axial end of the roll paper, and the roll support member is inserted into the roll paper. When the paper loading member is installed in the paper compartment, the first side of the flange of the paper loading member is the side of the flange that faces the opening of the paper loading member.

This configuration enables installing paper in the paper compartment by the simple process of inserting the roll support member of the paper loading member to the paper so that one side of the paper roll contacts one side of the flange, and then installing the paper loading member through the opening to the paper compartment.

Other features with a fuller understanding of the invention, will become apparent and appreciated by referring to the following description and claims taken in conjunction with the accompanying drawings.

DESCRIPTION OF EMBODIMENTS

Various embodiment are described below with reference to the accompanying figures.

Figure 1:
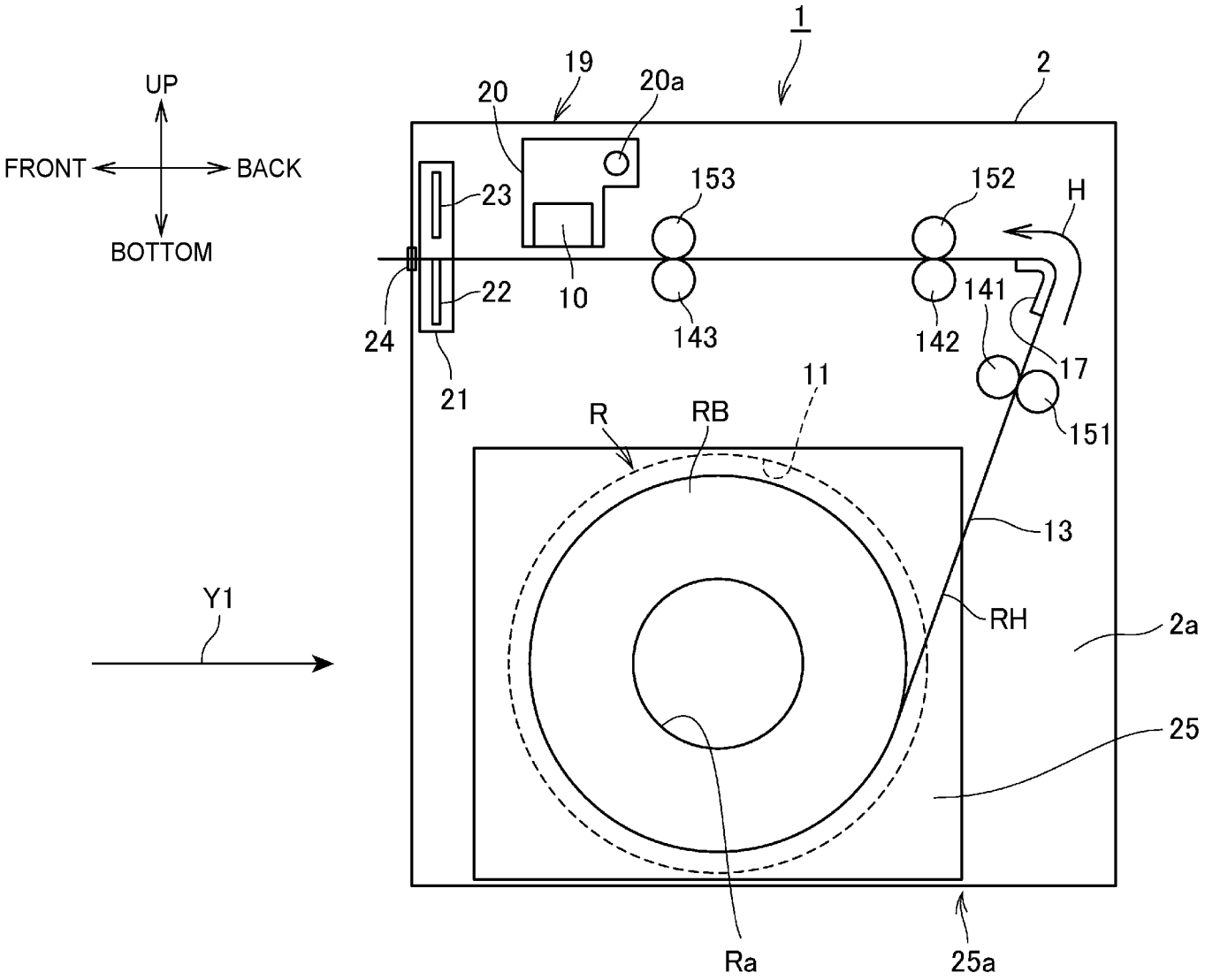
FIG. 1 illustrates the configuration of main parts of a printer.

FIG. 1 illustrates the configuration of main parts of a printer 1 (which may be, for example, a paper conveyance device or a printing device) according to a preferred embodiment.

As indicated by the arrows in FIG. 1, the direction to the left side of the figure is to the front of the printer 1 and the direction to the right side of the figure is to the back, the direction to the top side of the figure is to the top of the printer 1 and the direction to the bottom side of the figure is to the bottom.

The printer 1 in this example is a serial inkjet printer. The printer 1 stores roll paper R (paper wound into a roll), and delivers and conveys the roll paper R from the paper roll in the conveyance direction H. The printer 1 prints by ejecting ink onto the conveyed roll paper R from an inkjet head 10, which in this example is a serial inkjet head.

In this example, the printer 1 is a device that holds paper having multiple labels affixed at a regular interval to a continuous backing sheet R2 as the roll paper R, and continuously prints images on the labels. In another example, the printer 1 may be a large format printer (LFP).

As shown in FIG. 1, the printer 1 has a case 2. Inside the case 2 is a paper compartment 11 that is configured to hold the roll paper R. The paper compartment 11 is described in detail below. Herein, the portion of the roll paper R that is stored in a roll in the paper compartment 11 is referred to as the paper roll RB. The portion of the roll paper R that is delivered and conveyed from the paper roll RB stored in the paper compartment 11 is referred to as the conveyed roll paper RH.

As shown in FIG. 1, a conveyance path 13, which is the path through which the conveyed roll paper RH is conveyed, is formed inside the printer 1. The conveyed roll paper RH delivered from the paper roll RB is conveyed in the conveyance direction H through the conveyance path 13.

As shown in FIG. 1, disposed to the conveyance path 13 sequentially from the upstream side to the downstream side in the conveyance direction H are three conveyance rollers 141, 142, 143. Disposed at respective positions opposite the conveyance rollers 141, 142, 143 are driven rollers 151, 152, 153 that rotate following rotation of the conveyance rollers 141, 142, 143. The conveyed roll paper RH is held between the conveyance rollers 141, 142, 143 and driven rollers 151, 152, 153, and conveyed in the conveyance direction H according to rotation of the conveyance rollers 141, 142, 143. The conveyance rollers 141, 142, 143 are connected to a conveyance motor through a power transfer mechanism, and turn as driven by the conveyance motor.

As shown in FIG. 1, a guide member 17 is disposed between conveyance roller 141, which is located farthest upstream in the conveyance direction H, and the conveyance roller 142 located next downstream from the conveyance roller 141. The guide member 17 contacts the back side of the conveyed roll paper RH, and causes the conveyed roll paper RH conveyed up from the paper compartment 11 to curve toward the front of the printer 1. By contacting and causing the conveyed roll paper RH to curve, the guide member 17 applies tension to the conveyed roll paper RH, and suppresses the development of slack in the conveyed roll paper RH.

Conveyance roller 143 is disposed downstream in the conveyance direction H from the guide member 17 and conveyance roller 142, and downstream from the conveyance roller 143 is a printing mechanism 19.

The printer 1 includes a printing mechanism 19 that is configured to print on the roll paper R and includes a carriage 20, and an inkjet head 10 mounted on the carriage 20.

The carriage 20 is supported on a carriage rail 20*a* extending in the scanning direction perpendicular to the conveyance direction H, and moves the inkjet head 10 in the scanning direction along the carriage rail 20*a*.

The inkjet head 10 in this example is an inkjet head with nozzle rows for multiple colors of ink, such as the four colors cyan (C), yellow (Y), magenta (M), black (K). The inkjet head 10 prints by ejecting ink supplied from ink cartridges not shown from nozzles formed in nozzle rows, forming dots on the conveyed roll paper RH.

The inkjet head and other elements used for printing on the roll paper R embody a printing mechanism.

Downstream in the conveyance direction H from the printing mechanism 19 is a paper cutter 21. The paper cutter 21 includes a fixed knife 22, and a movable knife 23 that can move in a cutting action with the fixed knife 22. The paper cutter 21 moves the movable knife 23 to cut the conveyed roll paper RH.

Downstream in the conveyance direction H from the paper cutter 21 is the paper exit 24. The conveyed roll paper RH is discharged to the outside from the case 2 of the printer 1 through the paper exit 24.

At the side 2*a* of the case 2 is a cover 25. The cover 25 can pivot on a pin 25*a* between an open position and a closed position. When the cover 25 is open, the paper compartment 11 disposed inside the case 2 is exposed.

Figure 2:
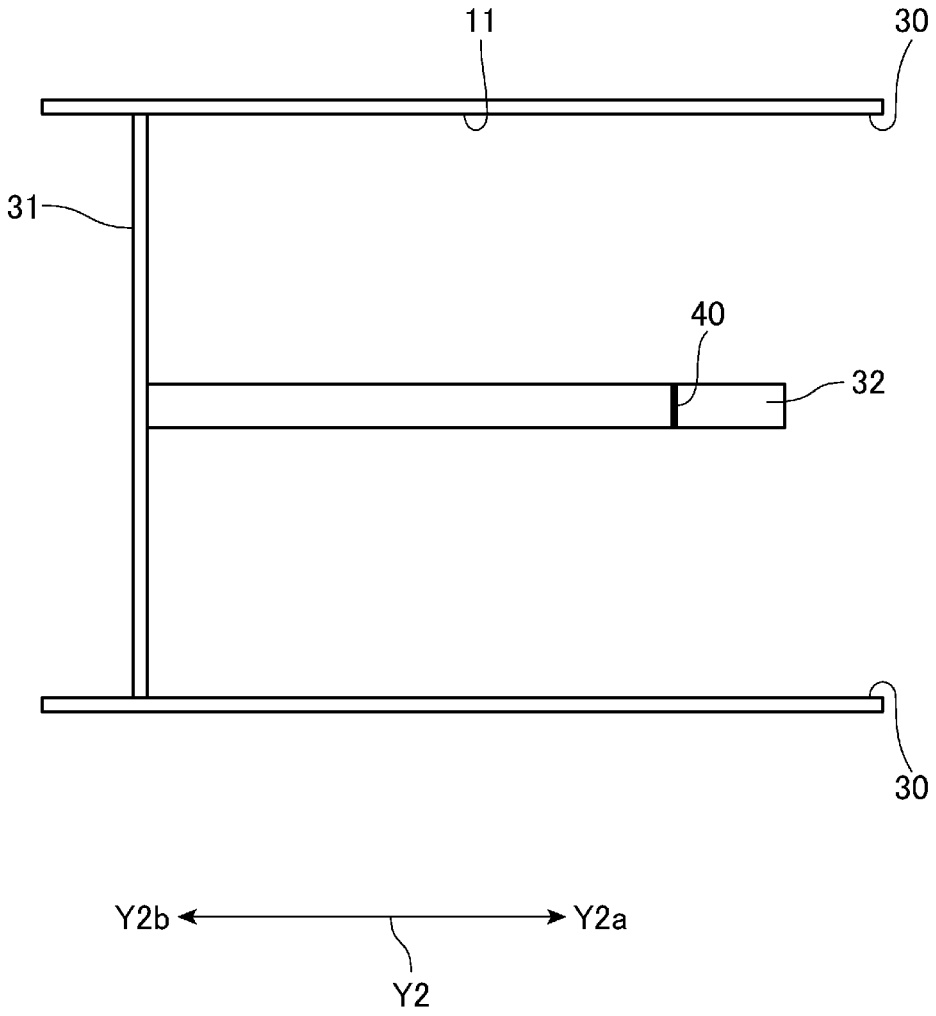
FIG. 2 illustrates the paper compartment.
Figure 3:
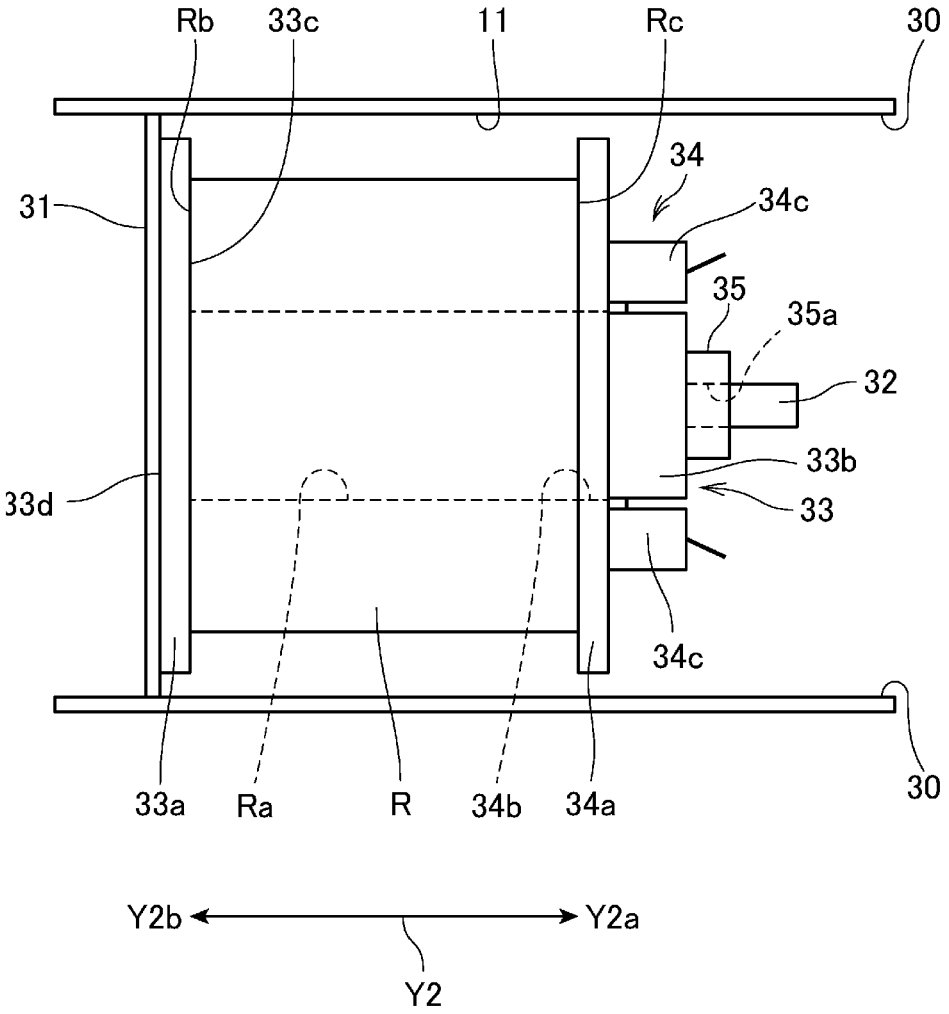
FIG. 3 shows the paper compartment when the paper loading member is installed in the paper compartment.

FIG. 2 and FIG. 3 schematically illustrate the paper compartment 11 as seen in the direction of arrow Y1 in FIG. 1, that is, from the front to the back of the printer 1. FIG. 2 shows the paper compartment 11 when the roll paper R is not in the paper compartment 11. FIG. 3 shows the paper compartment 11 when the roll paper R is loaded in the paper compartment 11.

Figure 7:
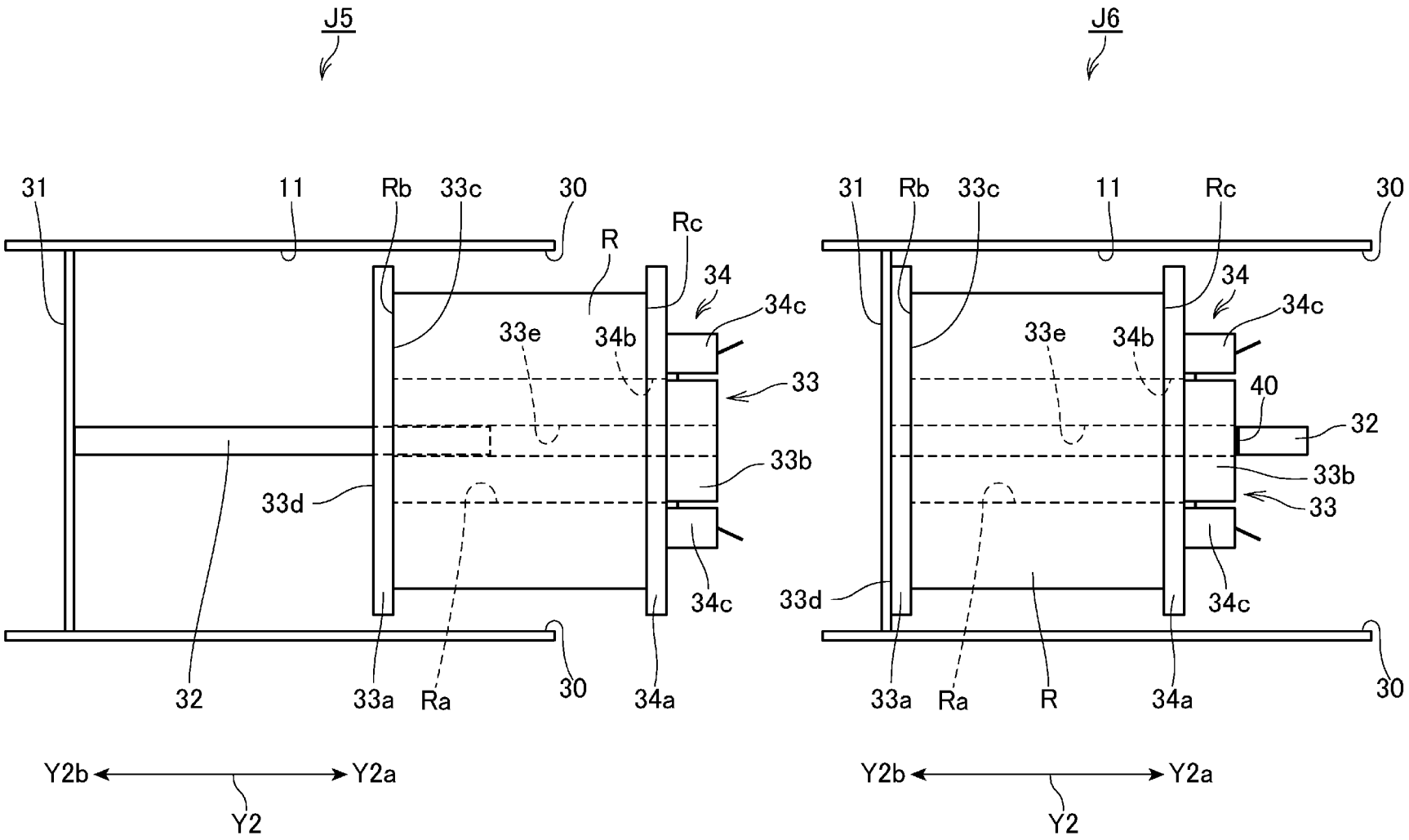
FIG. 7 illustrates installing the paper loading member to the paper compartment.

Below, when the roll paper R is stored in the paper compartment 11 as shown in FIG. 3, the direction through the core Ra of the roll paper R is referred to as the axial direction Y2. The axial direction Y2 corresponds to the direction across the width of the roll paper R stored in the paper compartment 11. In FIG. 2, FIG. 3, and FIG. 7, the direction to the right along the axial direction Y2 is referred to as right Y2*a*, and the direction to the left is referred to as left Y2*b*.

As shown in FIG. 2 and FIG. 3, the paper compartment 11 is a space large enough to accommodate roll paper R of the largest size that can be used in the printer 1. The paper compartment has an opening 30 formed at the right end of the paper compartment 11. More specifically, the opening 30 is positioned along one side (i.e., the second axial end Rc of the roll paper R toward the right Y2*a*) along the axial direction Y2 of the roll paper R when the roll paper R is held in the paper compartment 11. When the cover 25 opens, the paper compartment 11 is exposed through the opening 30, and the paper compartment 11 can be accessed.

As shown in FIG. 2, and FIG. 3, the paper compartment 11 has a wall 31 that is formed at the left end of the paper compartment 11. More specifically, the wall 31 is positioned closer to the first axial end Rb of the roll paper R than the second axial end Rc of the roll paper R (i.e., toward the left Y2*b*) along the axial direction Y2 of the roll paper R when the roll paper R is held in the paper compartment 11.

As shown in FIG. 2, the paper compartment 11 has a rod-shaped spindle 32 that projects in the axial direction Y2 from the center of the wall 31. The spindle 32 extends along the axial direction Y2 of the roll paper R that is held in the paper compartment 11. The function of the spindle 32 is described below.

As shown in FIG. 3, the printer 1 has a paper loading member 33 that is installed within the paper compartment 11 when the roll paper R is installed in the paper compartment 11, and the roll paper R, a paper stop 34, and a roll support member stop 35 are installed on the paper loading member 33. The relative positions of these members, and their shapes and functions, are described below.

The position (referred to below as the specified position) in the printer 1 to which the roll paper R should be installed in the axial direction Y2 of the paper compartment 11 is predefined, and when the roll paper R is set to the specified position, the roll paper R can be conveyed normally and the roll paper R printed on. When the user loads roll paper R into the paper compartment 11, enabling the user to easily and reliably set the roll paper R to the specified position, and thereby improve user convenience, has been desired. More specifically, the printer 1 according to this embodiment has a cover 25 on the side 2*a* of the case 2, the opening 30 to the paper compartment 11 is shaped according to the side 2*a* of the case 2 of the printer 1, and the user thus loads the roll paper R from the side of the case 2.

With a printer 1 in which the roll paper R is loaded from the side of the case 2, it is therefore difficult for the user to confirm the position of the roll paper R in the axial direction Y2 inside the paper compartment 11. As a result, a configuration enabling the user to easily and reliably position the roll paper R to the specified position when loading roll paper R into the paper compartment 11 has been strongly desired.

As described above, the printer 1 according to this embodiment also enables installing large format paper as the roll paper R. Because large format paper is large in size and heavy, the task of installing the roll paper R in the paper compartment 11 tends to be difficult. A configuration enabling the user to easily install the roll paper R when loading roll paper R into the paper compartment 11 is therefore also desired for this reason.

To address these problems, the printer 1 according to this embodiment is constructed as described below.

Figure 4:
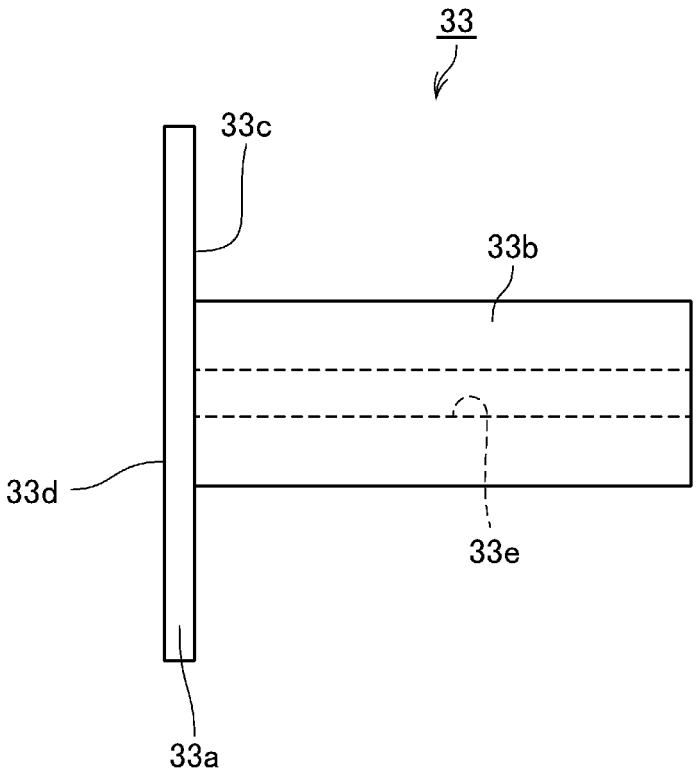
FIG. 4 illustrates the paper loading member.

FIG. 4 shows the paper loading member 33.

The paper loading member 33 is configured to be removably installed in the paper compartment 11 through the opening 30 and is used to store the roll paper R in the paper compartment 11. As will be understood below, when the roll paper R is installed in the paper compartment 11, the roll paper R is first installed on the paper loading member 33 outside the case 2, and the paper loading member 33 with roll paper R installed thereon is installed in the paper compartment 11.

As shown in FIG. 4, the paper loading member 33 has a flange 33*a* and a rod-shaped roll support member 33*b* protruding from the center of the flange 33*a*. When seen from the axial direction Y2, the flange 33*a* is shaped like a disk. The shape of the surface of the flange 33*a* corresponds to the shape of the surface of the wall 31.

As shown in FIG. 4, the roll support member 33*b* has a through-hole 33*e* that passes through the roll support member 33*b* in the lengthwise direction of the roll support member 33*b* is disposed in the roll support member 33*b*. The function of the through-hole 33*e* is described below. Note that the lengthwise direction of the roll support member 33*b* is the direction in which the roll support member 33*b* extends from the flange 33*a*, and corresponds to the axial direction Y2 of the roll paper R installed in the paper compartment 11.

Figure 5:
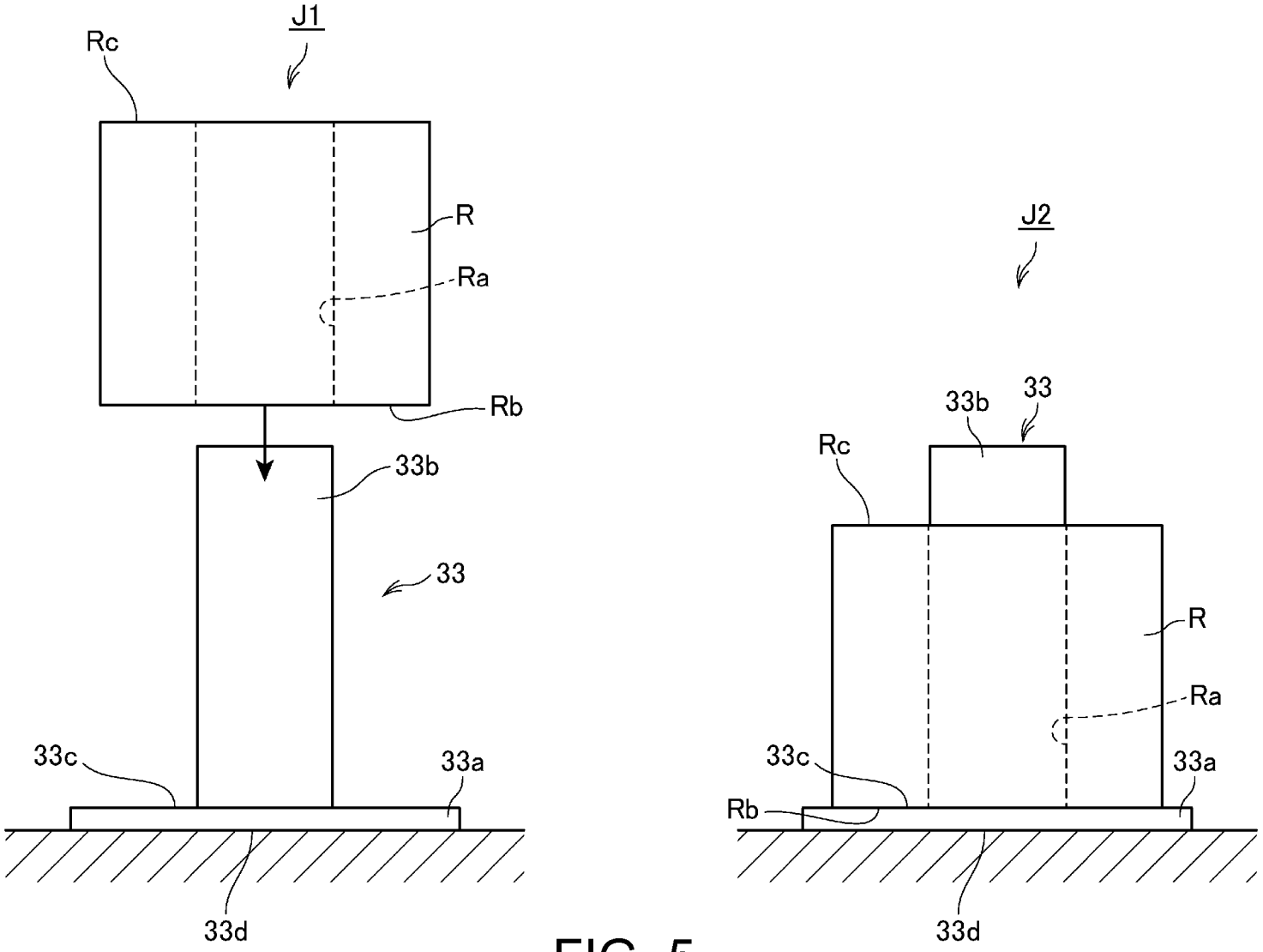
FIG. 5 illustrates installing a paper roll on the paper loading member.

FIG. 5 is used to describe the task of installing the roll paper R to the paper loading member 33. The roll paper R extends axially between a first axial end Rb and a second axial end Rc.

To install the roll paper R to the paper compartment 11, the user first removes the paper loading member 33 from the case 2, and sets the paper loading member 33 with the flange 33*a* down on a work table or other surface.

State J1 and state J2 in FIG. 5 show the paper loading member 33 sitting on a work surface. As shown in FIG. 5, the paper loading member 33 rests stably on the work surface when the roll support member 33*b* is upright.

After placing the roll support member 33*b* on the work surface, the user then installs the roll paper R to the paper loading member 33 (state J1 in FIG. 5) by inserting the roll support member 33*b* into the core Ra of the roll paper R. When the roll paper R is installed on the paper loading member 33, the user sets the first axial end Rb, which is one end of the roll paper R, against the first flange side 33*c*, which is a first side of the flange 33*a*. State J2 in FIG. 5 shows the first axial end Rb of the roll paper R in contact with the first flange side 33*c*.

As described above, when the paper loading member 33 is set on the work surface, the roll support member 33*b* stands vertically. As a result, after inserting the distal end of the roll support member 33*b* into the core Ra of the roll paper R, the user can push the roll paper R down until the first axial end Rb touches the first flange side 33*c*, using the force of gravity on the roll paper R. The user can therefore easily install the roll paper R to the paper loading member 33 with little effort.

Below, the first axial end Rb being in contact with the first flange side 33*c* is also referred to as the "contact position."

The maximum outside circumference of the roll support member 33*b* corresponds to the size of the inside circumference of the core Ra of the roll paper R. Therefore, when the core Ra is placed onto the roll support member 33*b* and in the contact position, the outside circumference of the roll support member 33*b* is in contact with the full inside circumference of the core Ra of the roll paper R, and the roll paper R is held by friction on the roll support member 33*b*. Note that a configuration in which an intervening member is disposed to the outside circumference of the roll support member 33*b*, and the roll support member 33*b* supports the roll paper R through the intervening member, is also conceivable.

The length in the lengthwise direction of the roll support member 33*b* is greater than the maximum width of the roll paper R than can be stored or installed in the paper compartment 11. As a result, as shown in state J2 in FIG. 5, when in the contact position, the roll support member 33*b* extends past the second axial end Rc (other end), which is the opposite end (side) of the roll paper R as the first axial end Rb. As a result, support of the roll paper R by the roll support member 33*b* is stable.

After installing the roll paper R to the paper loading member 33, the user installs the paper stop 34 to the roll support member 33*b* of the paper loading member 33.

Figure 6:
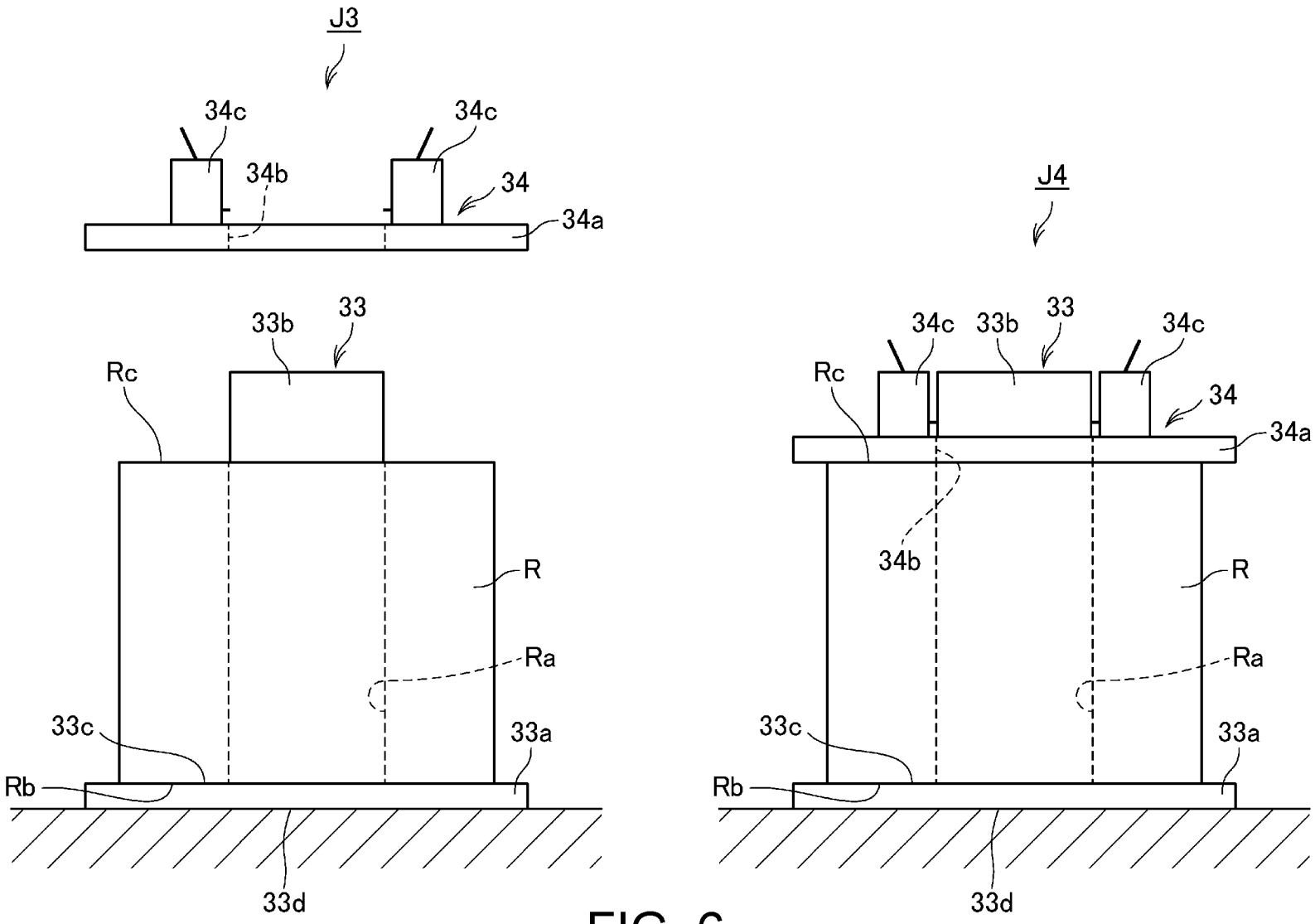
FIG. 6 illustrates installing the paper stop to the roll support member.

FIG. 6 describes the operation when installing the paper stop 34 to the roll support member 33*b*.

The paper stop 34 is a member that restricts the position (or movement) of the roll paper R on (or along) the roll support member 33*b*. The paper stop 34 has a round base 34*a*. In the center of the base 34*a* is an insertion hole 34*b* with an inside circumference of a size corresponding to the size of the outside circumference of the roll support member 33*b*. Clamps 34*c* for securing the paper stop 34 to the roll support member 33*b* are disposed around the insertion hole 34*b*.

As shown by state J3 and state J4 in FIG. 6, when installing the paper stop 34 to the roll support member 33*b*, the user moves the paper stop 34 with the roll support member 33*b* inserted into the insertion hole 34*b* to the roll paper R side until the one side of the base 34*a* of the paper stop 34 contacts the second axial end Rc of the roll paper R (the position indicated by state J4 in FIG. 6). When the one side of the base 34*a* of the paper stop 34 contacts the second axial end Rc of the roll paper R, the paper stop 34 is fastened to the roll support member 33*b* by the specific mechanism of the clamps 34*c*. By securing the paper stop 34 to the roll support member 33*b*, the roll paper R is held between the flange 33*a* and paper stop 34, and the position of the roll paper R on the roll support member 33*b* is thereby restricted.

After installing the paper stop 34 to the roll support member 33*b*, the user opens the cover 25 to expose the paper compartment 11, and installs the paper loading member 33 in the paper compartment 11.

FIG. 7 describes the task of installing the paper loading member 33 in the paper compartment 11.

As indicated by state J5 and state J6 in FIG. 7, to install the paper loading member 33 in the paper compartment 11, the user moves the paper loading member 33 (with the spindle 32 inserted into the through-hole 33*e*) to the wall 31 side (left Y2*b* side) until the second flange side 33*d* (i.e., the second side of the flange 33*a*), which is the opposite side of the flange 33*a* as the first flange side 33*c*, contacts the wall 31 (state J6 shown in FIG. 7). The second flange side 33*d* of the flange 33*a* faces the wall 31 of the paper compartment 11.

More specifically, after inserting the distal end of the spindle 32 into the through-hole 33*e* of the roll support member 33*b* (state J5 in FIG. 7), the user pushes the paper loading member 33 to the left. Because the paper loading member 33 is supported by the spindle 32 while being pushed to the left, the load on the user is small and the user can easily push the paper loading member 33 even when the size of the roll paper R is large and the roll paper R is heavy. As the paper loading member 33 is pushed, the second flange side 33*d* contacts the wall 31 (state J6 in FIG. 7), and the paper loading member 33 cannot be pushed further to the left Y2*b* side. Pushing the paper loading member 33 into place ends when the paper loading member 33 no longer moves when pushed by the user.

When the second flange side 33*d* is touching the wall 31 is referred to below as the installed state.

When the paper loading member 33 is in the installed state, the first flange side 33*c* of the flange 33*a* is on the opening 30 side.

When the roll paper R is installed on the paper loading member 33 and the paper loading member 33 is in the installed state, the roll paper R is in the specified position.

In this embodiment, the user can reliably position the roll paper R to the specified position by the simple operation of inserting the spindle 32 into the through-hole 33*e* of the roll support member 33*b*, and then pushing the paper loading member 33 until the paper loading member 33 no longer moves when pushed by the user.

In the installed position, the spindle 32 supports the roll support member 33*b*. The length of the spindle 32 is greater than the length of the roll support member 33*b*. As a result, when the paper loading member 33 is in the installed position as shown in state J6 in FIG. 7, the end of the spindle 32 on the opening 30 side is closer to the opening 30 side than the end of the roll support member 33*b* on the opening 30 side. As a result, in the installed position, support of the roll support member 33*b* by the spindle 32 is stable.

A index mark 40 (for example, a marking) is disposed to the spindle 32. As shown in state J6 in FIG. 7, the index mark 40 is disposed to the spindle 32 at a position corresponding to the position on the opening 30 side end of the roll support member 33*b* in the installed position. The user can reliably know if the roll paper R is in the installed position by checking the position of the opening 30 side end of the roll support member 33*b* relative to the index mark 40.

In this embodiment, the second flange side 33*d* directly contacts the wall 31 in the installed position. In this respect, a configuration that disposes an intervening member on the wall 31, and the position of the paper loading member 33 in the paper compartment 11 is restricted by contact by the second flange side 33*d* with the intervening member, is also conceivable.

After installing the paper loading member 33 in the paper compartment 11, the user installs the roll support member stop 35 (see FIG. 3) to the spindle 32.

The roll support member stop 35 is a member that is configured to restrict the position of the roll support member 33*b* on the spindle 32. The roll support member stop 35 has a through-hole 35*a* with an inside circumference of a size corresponding to the size of the outside circumference of the spindle 32.

As shown in FIG. 3, when installing the roll support member stop 35 to the spindle 32, the user moves the roll support member stop 35 with the spindle 32 inserted into the through-hole 35*a* thereof to the wall 31 side (left Y2*b* side) until the one side of the roll support member stop 35 contacts the opening 30 side end of the roll support member 33*b*. When one side of the roll support member stop 35 is in contact with the opening 30 side end of the roll support member 33*b*, the roll support member stop 35 is fastened to the spindle 32 by the specific mechanism of the roll support member stop 35. By fastening the roll support member stop 35 to the spindle 32, the paper loading member 33 is held between the wall 31 and the roll support member stop 35, and the position or any movement of the roll support member 33*b* on the spindle 32 is thereby restricted along the spindle 32.

As described above, the printer 1 (i.e., the paper conveyance device) has an opening 30 enabling a roll paper R (i.e., a paper roll) to be stored and positioned along one end of the axial direction Y2 of the roll paper R when stored, and a paper compartment 11 having a wall 31 on the other end of the axial direction Y2 of the roll paper R when stored. The printer 1 also has a paper loading member 33 that can be installed in and removed from the paper compartment 11 through the opening 30. The paper loading member 33 has a flange 33*a* and a roll support member 33*b* that protrudes from the flange 33*a* and is configured to be inserted into the core Ra of the roll paper R.

When the roll paper R is installed or stored in the paper compartment 11, the paper loading member 33 is installed in the paper compartment 11 with the first flange side 33*c* (one side) of the flange 33*a* in contact with the first axial end Rb (one side) of the roll paper R, and the roll support member 33*b* is inserted into the core Ra of the roll paper R.

When the paper loading member 33 is installed in the paper compartment 11, the first flange side 33*c* of the flange 33*a* of the paper loading member 33 is the side of the flange 33*a* that is closer to or faces the opening 30 of the paper compartment 11. Thus comprised, the roll paper R can be installed in the paper compartment 11 by the simple task of putting the roll paper R on the roll support member 33*b* of the paper loading member 33 so that the first axial end Rb contacts the first flange side 33*c*, and then installing the paper loading member 33 through the opening 30 into the paper compartment 11.

Even when the paper loading member 33 is installed in the paper compartment 11, the user can remove and install roll paper R to the paper loading member 33, and the paper can be installed appropriately to the training of the user.

In this embodiment, the length of the roll support member 33*b* is greater than the length of the roll paper R of the greatest width that can be held in the paper compartment 11. Thus comprised, the roll support member 33*b* can stably support the roll paper R.

The roll support member 33*b* in this embodiment has a through-hole 33*e* passing lengthwise through the roll support member 33*b*. The paper compartment 11 has a spindle 32 that protrudes in the axial direction Y2 of the roll paper R when installed in the paper compartment 11. When the paper loading member 33 is installed in the paper compartment 11, the spindle 32 is inserted into the through-hole 33*e* of the roll support member 33*b*. Thus comprised, the paper loading member 33 can be installed in the paper compartment 11 by the simple task of inserting the spindle 32 into the second flange side 33*d* of the roll support member 33*b*.

In this example, the length of the spindle 32 is greater than the length of the roll support member 33*b*, and when the paper loading member 33 is installed in the paper compartment 11, the opening-side end of the spindle 32 of the paper compartment 11 is closer to the opening 30 of the paper compartment 11 than the opening-side end of the roll support member 33*b* of the paper loading member 33. The spindle 32 extends axially between a first end and a second end, where the second end is the opening-side end of the spindle 32 and is closer to the opening 30 than the first end of the spindle 32. The roll support member 33*b* extends axially between a first end and a second end, where the second end is the opening-side end of the roll support member 33*b* and is closer to the opening 30 than the first end of the roll support member 33*b* (when the paper loading member 33 is installed in the paper compartment 11). Thus comprised, the roll support member 33*b* can be stably supported by the spindle 32.

The spindle 32 in this example has a marking (for example, the index mark 40) indicating the position of the opening-side end of the roll support member 33*b*. Thus comprised, using the marking on the spindle 32, the user can determine whether or not the roll support member 33*b* is positioned appropriately on the spindle 32.

The printer 1 according to this embodiment also has a roll support member stop 35, which is configured to be installed on the spindle 32 to which the paper loading member 33 is installed and restrict the position of the roll support member 33*b* on the spindle 32. Thus comprised, the position of the roll support member 33*b* on the spindle 32 can be appropriately limited by the roll support member stop 35.

The printer 1 according to this embodiment also has a paper stop 34 that is configured to be installed on the roll support member 33*b* when the first axial end Rb of the roll paper R is in contact with the first flange side 33*c* of the flange 33*a* and the roll support member 33*b* is inserted into the core Ra of the roll paper R, contact the second axial end Rc (other end) of the roll paper R installed on the roll support member 33*b*, and restrict the position of the roll paper R on the roll support member 33*b*. This configuration enables appropriately controlling, with the paper stop 34, the position of the roll paper R on the roll support member 33*b*.

The invention is described above with reference to a preferred embodiment thereof, but the invention is not limited thereto and can be modified and adapted in many ways without departing from the scope of the accompanying claims.

For example, the paper conveyance device and printing device in the foregoing embodiment are used with an inkjet printer. However, the paper conveyance device and printing device are not limited to use with an inkjet printer. For example, the paper conveyance device and printing device can be widely deployed in devices that can store and process paper (media) in a roll. For example, the paper conveyance device and printing device can be used with devices that print to small format paper, such as receipt printers, scanners that optically read stored paper, and other devices.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A paper conveyance device comprising:

a paper compartment configured to hold roll paper that extends between a first axial end of the roll paper and a second axial end of the roll paper, the paper compartment having an opening positioned along the second axial end of the roll paper when the roll paper is held in the paper compartment;

a paper loading member configured to be removably installed in the paper compartment via the opening, wherein the paper loading member is removably installed by moving in an axial direction of the roll paper held in the paper compartment, the paper loading member including a flange and a roll support member that protrudes from the flange and is configured to be inserted into the roll paper; and a cover configured to be movable between an open position and a closed position, wherein, when the cover is in the closed position, the axial direction of the roll paper held in the paper compartment is perpendicular to the closed position of the cover, wherein, when the cover is in the closed position, the roll paper and the cover overlap when viewed from the axial direction of the roll paper held in the paper compartment, wherein, when the cover is in the open position, the roll paper and the cover do not overlap when viewed from the axial direction of the roll paper held in the paper compartment, wherein, when the roll paper is held in the paper compartment, the paper loading member is installed in the paper compartment with a first side of the flange contacting the first axial end of the roll paper, and the roll support member is inserted into the roll paper, and wherein, when the paper loading member is installed in the paper compartment, the first side of the flange of the paper loading member faces the cover.

2. The paper conveyance device described in claim 1, wherein:

a length of the roll support member is greater than a maximum width of the roll paper held in the paper compartment.

3. The paper conveyance device described in claim 1, wherein:

the roll support member has a through-hole passing lengthwise through the roll support member;

the paper compartment has a roll spindle extending along the axial direction of the roll paper held in the paper compartment; and the roll spindle is inserted into the through-hole of the roll support member when the paper loading member is installed in the paper compartment.

4. The paper conveyance device described in claim 3, wherein:

a length of the roll spindle is greater than a length of the roll support member; and when the paper loading member is installed in the paper compartment, an opening-side end of the roll spindle of the paper compartment is closer to the opening of the paper compartment than an opening-side end of the roll support member of the paper loading member.

5. The paper conveyance device described in claim 4, wherein:

the roll spindle has a marking indicating a position of the opening-side end of the roll support member.

6. The paper conveyance device described in claim 4, further comprising:

a roll support member stop configured to be installed on the roll spindle to which the paper loading member is installed and restrict a position of the roll support member on the roll spindle.

7. The paper conveyance device described in claim 6, further comprising:

a paper stop configured to be installed on the roll support member and is different from the roll support member stop, wherein the roll support member stop has a through-hole with an inside circumference equal to a size of an outside circumference of the roll spindle.

8. The paper conveyance device described in claim 4, further comprising:

a paper stop configured to be installed to the roll support member when the first axial end of the roll paper is in contact with one side of the flange and the roll support member is inserted into the roll paper, contact the second axial end of the roll paper installed on the roll support member, and restrict a position of the roll paper on the roll support member.

9. The paper conveyance device described in claim 8, wherein:

the paper stop includes a first clamp and a second clamp, and the paper stop is fastened to the roll support member using the first clamp and the second clamp.

10. The paper conveyance device described in claim 8, wherein:

the paper stop has a through-hole with an inside circumference corresponding to a size of an outside circumference of the roll support member, and the roll support member protrudes from the through-hole of the paper stop.

11. The paper conveyance device described in claim 1, wherein:

the paper compartment has a wall positioned in an opposite side to the opening when the roll paper is held in the paper compartment.

12. The paper conveyance device described in claim 11, wherein:

when the paper loading member is installed in the paper compartment, a second side of the flange contacts the wall, wherein the second side of the flange faces the wall of the paper compartment.

13. A printing device comprising:

a paper compartment configured to hold roll paper that extends between a first axial end of the roll paper and a second axial end of the roll paper, the paper compartment having an opening positioned along the second axial end of the roll paper when the roll paper is held in the paper compartment and a wall positioned along the first axial end of the roll paper when the roll paper is held in the paper compartment;

a printing mechanism configured to print on the roll paper;

a paper loading member configured to be removably installed in the paper compartment via the opening, wherein the paper loading member is removably installed by moving in an axial direction of the roll paper held in the paper compartment, the paper loading member including a flange and a roll support member that protrudes from the flange and is configured to be inserted into the roll paper; and a cover configured to be movable between an open position and a closed position, wherein when the cover is in the closed position, the axial direction of the roll paper held in the paper compartment is perpendicular to the closed position of the cover, wherein, when the cover is in the closed position, the roll paper and the cover overlap when viewed from the axial direction of the roll paper held in the paper compartment, wherein when the cover is in the open position, the roll paper and the cover do not overlap when viewed from the axial direction of the roll paper held in the paper compartment, wherein, when the roll paper is held in the paper compartment, the paper loading member is installed in the paper compartment with a first side of the flange contacting the first axial end of the roll paper, and the roll support member is inserted into the roll paper, and wherein, when the paper loading member is installed in the paper compartment, the first side of the flange of the paper loading member is the side of the flange that faces the cover.

* * * * *